US012158283B2

(12) United States Patent
Mai et al.

(10) Patent No.: US 12,158,283 B2
(45) Date of Patent: Dec. 3, 2024

(54) THREE-PIPE MULTI-SPLIT AIR-CONDITIONING SYSTEM AND CONTROL METHOD THEREOF

(71) Applicant: Guangdong Giwee Technology Co. Ltd., Foshan (CN)

(72) Inventors: Xiangshi Mai, Foshan (CN); Defu Gao, Foshan (CN); Hongbin Liu, Foshan (CN)

(73) Assignee: GUANGDONG GIWEE TECHNOLOGY CO. LTD., Foshan (CN)

( * ) Notice: Subject to any disclaimer, the term of this patent is extended or adjusted under 35 U.S.C. 154(b) by 293 days.

(21) Appl. No.: 17/551,749

(22) Filed: Dec. 15, 2021

(65) Prior Publication Data

US 2022/0196259 A1 Jun. 23, 2022

(51) Int. Cl.
*F24F 5/00* (2006.01)
*F24F 3/00* (2006.01)
(Continued)

(52) U.S. Cl.
CPC ..... *F24F 3/065* (2013.01); *F24F 3/001* (2013.01); *F24F 11/49* (2018.01); *F24F 11/84* (2018.01);
(Continued)

(58) Field of Classification Search
CPC ..... F25B 2313/0233; F25B 2313/0231; F25B 2313/007; F25B 2313/003; F25B 6/00–6/04
See application file for complete search history.

(56) References Cited

U.S. PATENT DOCUMENTS 5,647,224 A * 7/1997 Kushiro ..... F25B 9/006 62/502
7,607,317 B2 * 10/2009 Honda ..... F25B 31/004 62/174
(Continued)

FOREIGN PATENT DOCUMENTS

CN 104154692 A 11/2014
CN 109405102 A 3/2019
(Continued)

OTHER PUBLICATIONS

European Search Report for Application No. 21213365.6; Issued May 10, 2022; 7 Pages.
(Continued)

*Primary Examiner* — Frantz F Jules
*Assistant Examiner* — Jason N Thompson
(74) *Attorney, Agent, or Firm* — CANTOR COLBURN LLP

(57) ABSTRACT

A three-pipe, multi-split system and a control method thereof. The three-pipe multi-split system includes an outdoor unit, a multi-split indoor unit, and a hydraulic module. By optimizing a refrigerant system, the phenomenon that a refrigerant is throttled before flowing through a refrigerant heat dissipation module or supercooled when passing through a plate heat exchanger which causes a relatively low temperature of the refrigerant entering the refrigerant heat dissipation module and consequent condensation on the refrigerant heat dissipation module to produce condensate water and then causes a damage to a compressor frequency conversion module can be avoided. In addition, more refrigerant is caused to flow through the refrigerant heat dissipation module to reduce the temperature of the module.

7 Claims, 1 Drawing Sheet

(51) Int. Cl.

| | |
|---|---|
| ***F24F 3/06*** | (2006.01) |
| ***F24F 11/49*** | (2018.01) |
| ***F24F 11/84*** | (2018.01) |
| ***F25B 29/00*** | (2006.01) |
| ***F25B 41/20*** | (2021.01) |
| ***F25B 41/42*** | (2021.01) |
| *F24F 110/10* | (2018.01) |
| *F24F 140/20* | (2018.01) |

(52) U.S. Cl.
CPC ..... *F24F 2003/003* (2013.01); *F24F 2110/10* (2018.01); *F24F 2140/20* (2018.01)

(56) References Cited

U.S. PATENT DOCUMENTS

2011/0048054 A1* 3/2011 Sekine ..... F25B 13/00 62/335
2013/0219945 A1* 8/2013 Koge ..... F24F 3/06 62/324.6
2015/0040595 A1* 2/2015 Tamaki ..... F24D 17/001 62/159
2019/0383516 A1* 12/2019 Baba ..... F24F 11/61
2022/0205692 A1* 6/2022 Zhou ..... F25B 31/004
2022/0205695 A1* 6/2022 Zhou ..... F25B 13/00
2022/0235983 A1* 7/2022 Mai ..... F25B 41/20

FOREIGN PATENT DOCUMENTS

CN 110953758 A 4/2020
CN 111486574 A 8/2020
WO 2008059922 A1 5/2008

OTHER PUBLICATIONS

Chinese Office Action for Application No. 202011497404.8, Issued Dec. 2, 2021, 9 Pages.

* cited by examiner

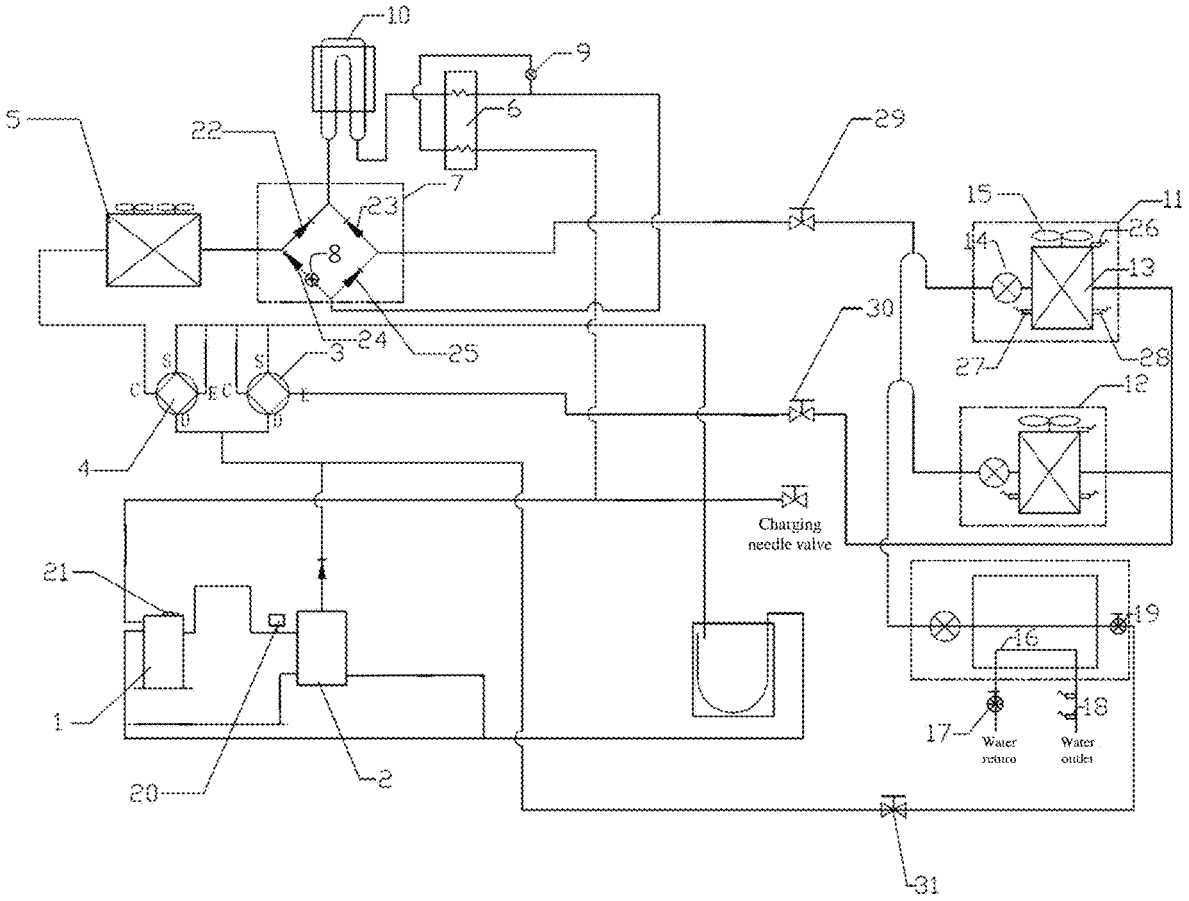
10
9
6
5
22
7
23
29
15
11
26
14
13
8
3
24
25
30
27
28
12
4
Charging
needle valve
21
19
16
1
17
18
Water
inlet
Water
outlet
20
2
31

THREE-PIPE MULTI-SPLIT AIR-CONDITIONING SYSTEM AND CONTROL METHOD THEREOF

FOREIGN PRIORITY

This application claims priority to Chinese Patent Application No. 202011497404.8, filed Dec. 17, 2020, and all the benefits accruing therefrom under 35 U.S.C. § 119, the contents of which in its entirety are herein incorporated by reference.

TECHNICAL FIELD

The present disclosure relates to the technical field of air conditioners, and in particular to a three-pipe multi-split system and a control method thereof.

BACKGROUND

In an existing multi-split hot water system, the air-cooled heat exchangers of an outdoor unit are all used as either evaporators or condensers; and the refrigerant heat dissipation of a current multi-split hot water system occurs after electronic expansion during refrigeration, which has a certain throttling effect on the refrigerant, and the refrigerant throttled by an electronic expansion valve has a relatively low temperature. When the low-temperature refrigerant flows through a refrigerant heat dissipation module, condensate water is easily produced on the surface of the refrigerant heat dissipation module; and the low-temperature condensate water is very likely to cause short circuit of an electric control component when in contact with the electric control component, ensuing safety accidents such as electric leakage of the electric control component. In a heating mode of the refrigerant heat dissipation of the multi-split hot water system, the refrigerant is supercooled by a plate heat exchanger and has a relatively low temperature; so, the refrigerant flowing through the refrigerant heat dissipation module has a low temperature, bringing a relatively great risk of condensation. After the multi-split hot water system switches off an outdoor unit heat exchanger, there is no refrigerant flowing through the refrigerant heat dissipation module, and a compressor frequency conversion module cannot achieve sufficient heat dissipation; and meanwhile, in a case where the compressor frequency conversion module has a relatively high temperature, it is difficult to ensure that enough refrigerant flows through the refrigerant heat dissipation module, causing the high temperature of the compressor frequency conversion module and it is difficult to protect the frequency conversion module.

SUMMARY

An embodiment of the present invention provides a three-pipe multi-split hot water system, comprising: an outdoor unit comprising a compressor, an oil separator, a first four-way valve, a second four-way valve, a finned heat exchanger, a plate heat exchanger, a refrigerant reversing module, a first electronic expansion valve, a second electronic expansion valve, and a compressor heat dissipation module, wherein the compressor is communicated with the oil separator; the compressor heat dissipation module is communicated with the plate heat exchanger; and the plate heat exchanger is communicated with the second electronic expansion valve; a multi-split indoor unit equipped with at least two indoor units, any two of the indoor units comprising a first indoor unit, a second indoor unit, an indoor unit heat exchanger, an indoor unit electronic expansion valve, and an indoor unit fan, wherein the indoor unit electronic expansion valve is communicated with the indoor unit heat exchanger; and a hydraulic module comprising a refrigerant water heat exchanger, a water pump, a water flow switch, and an electromagnetic valve, wherein the water pump is communicated with the water flow switch and equipped with a water temperature detection sensor for detecting water temperature.

Preferably, the compressor is communicated with the oil separator; a high-pressure sensor is disposed on the connection between the compressor and the oil separator; and the high-pressure sensor is configured to detect the pressure of a liquid loop.

Preferably, the multi-split outdoor unit is equipped with a frequency conversion module temperature sensor for the compressor.

Preferably, the three-pipe multi-split hot water system further comprises: a first one-way valve that only allows a flow from the finned heat exchanger to the compressor heat dissipation module, a second one-way valve that only allows a flow from the refrigerant reversing module to the compressor heat dissipation module, a third one-way valve that only allows a flow from the cold plate heat exchanger to the finned heat exchanger, and a fourth one-way valve that only allows a flow from the first electronic expansion valve to the refrigerant reversing module.

Preferably, any two of the indoor units are equipped with a first temperature sensor configured to detect the environment of the corresponding indoor unit, a second temperature sensor disposed at the middle of the corresponding indoor unit heat exchanger, and a third temperature sensor for detecting the exit temperature of the corresponding indoor unit heat exchanger.

Preferably, the outdoor unit is connected to any two of the indoor units and the hydraulic module through an air pipe, a liquid pipe, and a high-low pressure pipe respectively.

Preferably, the three-pipe multi-split hot water system further comprises stop valves used for outer connection of the outdoor unit, the stop valves being a liquid-side stop valve, an air-side stop valve, and a hydraulic module stop valve respectively, wherein the liquid-side stop valve is disposed in the liquid pipe connecting the outdoor unit to any two of the indoor units and the hydraulic module; the air-side stop valve is disposed in the air pipe connecting the outdoor unit to any two of the indoor units; and the hydraulic module stop valve is disposed in the air pipe connecting the outdoor unit to the hydraulic module.

On another aspect, the present invention also discloses a three-pipe multi-split system and a control method thereof; and the three-pipe multi-split system is a three-pipe multi-split system according to the embodiment of the first aspect of the present invention.

Preferably, when the heat exchanger of the outdoor unit is switched on, the outdoor unit is used as a condenser or an evaporator.

Preferably, when the heat exchanger of the outdoor unit is switched on and the outdoor unit is used as a condenser, the one-way valves in the outdoor unit are adjusted so that the first one-way valve and the fourth one-way valve are turned on, and the second one-way valve and the third one-way valve are turned off; when the heat exchanger of the air-conditioning outdoor unit is switched on and the outdoor unit is used as an evaporator, the one-way valves in the outdoor unit are adjusted so that the second one-way valve and the third one-way valve are turned on, and the first one-way valve and the fourth one-way valve are turned off; and when the frequency conversion module temperature sensor for the compressor is high, the first electronic expansion valve and the second electronic expansion valve are switched on.

The three-pipe multi-split system and the control method thereof provided by the present invention have the following beneficial effects: by optimizing a refrigerant system, the phenomenon that a refrigerant is throttled before flowing through a refrigerant heat dissipation module or supercooled when passing through a plate heat exchanger which causes a relatively low temperature of the refrigerant entering the refrigerant heat dissipation module and consequent condensation on the refrigerant heat dissipation module to produce condensate water and then causes a damage to a compressor frequency conversion module can be avoided. In addition, more refrigerant is caused to flow through the refrigerant heat dissipation module to reduce the temperature of the module. Meanwhile, a cooperation system increases control logics to avoid an excessively high temperature of the module, thereby effectively reducing the temperature of the compressor module, ensuring the unidirectionality of the refrigerant flowing through a first electronic expansion valve, and improving the cut-off capacity and reliability of the first electronic expansion valve.

BRIEF DESCRIPTION OF THE DRAWINGS

In order to more clearly describe the technical solutions of the present invention, the drawings used for the description are briefly described below. Apparently, the drawings described below are only some embodiments of the present invention. Those of ordinary skill in the art can obtain other drawings according to these drawings without creative efforts.

FIG. 1 is a schematic diagram illustrating the overall structure of the three-pipe multi-split system of the present invention.

In the FIGURE: 1-compressor, 2-oil separator, 3-first four-way valve, 4-second four-way valve, 5-finned heat exchanger, 6-plate heat exchanger, 7-refrigerant reversing module, 8-first electronic expansion valve, 9-second electronic expansion valve, 10-compressor heat dissipation module, 11-first indoor unit, 12-second indoor unit, 13-indoor unit heat exchanger, 14-indoor unit electronic expansion valve, 15-indoor unit fan, 16-refrigerant water heat exchanger, 17-water pump, 18-water flow switch, 19-electromagnetic valve, 20-high-pressure sensor, 21-frequency conversion module temperature sensor, 22-first one-way valve, 23-second one-way valve, 24-third one-way valve, 25-fourth one-way valve, 26-first temperature sensor, 27-second temperature sensor, 28-third temperature sensor, 29-liquid-side stop valve, 30-air-side stop valve, 31-hydraulic module stop valve.

DETAILED DESCRIPTION

Preferred implementations of the present invention are described below with reference to the drawings. It should be understood by those skilled in the art that these implementations are only used for an explanation of the technical principles of the present invention, rather than a purpose of limiting the scope of the present invention.

In the description of the present invention, it should be understood that the directions or positional relationships indicated by the terminologies such as "upper," "lower," "left," "right," "in," "out" are based on the directions or positional relationships shown in the drawings, and are only used for convenient and simple description of the present invention, instead of indicating or implying that the position or element involved must have a specific direction, or be structured or operated in a specific direction, which thus cannot be interpreted as a limitation to the present invention. In addition, the features defined with "first" and "second" can explicitly or implicitly include one or more of the features. In the description of the present invention, unless otherwise specified, "a plurality of" means two or more.

FIG. 1 is a schematic diagram illustrating the overall structure of the three-pipe multi-split system of the present invention. A three-pipe multi-split hot water system includes: an outdoor unit including a compressor 1, an oil separator 2, a first four-way valve 3, a second four-way valve 4, a finned heat exchanger 5, a plate heat exchanger 6, a refrigerant reversing module 7, a first electronic expansion valve 8, a second electronic expansion valve 9, and a compressor heat dissipation module 10, where the compressor 1 is communicated with the oil separator 2; the compressor heat dissipation module 10 is communicated with the plate heat exchanger 6; and the plate heat exchanger 6 is communicated with the second electronic expansion valve 9; a multi-split indoor unit equipped with at least two indoor units, any two of the indoor units including a first indoor unit 11, a second indoor unit 12, an indoor unit heat exchanger 13, an indoor unit electronic expansion valve 14, and an indoor unit fan 15, where the indoor unit electronic expansion valve 14 is communicated with the indoor unit heat exchanger 13; and a hydraulic module including a refrigerant water heat exchanger 16, a water pump 17, a water flow switch 18, and an electromagnetic valve 19, where the water pump 17 is communicated with the water flow switch 18 and equipped with a water temperature detection sensor for detecting water temperature.

Specifically, the compressor 1 is communicated with the oil separator 2; a high-pressure sensor 20 is disposed on the connection between the compressor 1 and the oil separator 2; and the high-pressure sensor 20 is configured to detect the pressure of a liquid loop.

Specifically, the multi-split outdoor unit is equipped with a frequency conversion module temperature sensor 21 for the compressor 1.

Specifically, the three-pipe multi-split hot water system further includes: a first one-way valve 22 that only allows a flow from the finned heat exchanger 5 to the compressor heat dissipation module 10, a second one-way valve 23 that only allows a flow from the refrigerant reversing module 7 to the compressor heat dissipation module 10, a third one-way valve 24 that only allows a flow from the cold plate heat exchanger 6 to the finned heat exchanger 5, and a fourth one-way valve 25 that only allows a flow from the first electronic expansion valve 8 to the refrigerant reversing module 7.

Specifically, any two of the indoor units are equipped with a first temperature sensor 26 configured to detect the environment of the corresponding indoor unit, a second temperature sensor 27 disposed at the middle of the corresponding indoor unit heat exchanger 13, and a third temperature sensor 28 for detecting the exit temperature of the corresponding indoor unit heat exchanger 13.

Specifically, the outdoor unit is connected to any two of the indoor units and the hydraulic module through an air pipe, a liquid pipe, and a high-low pressure pipe respectively.

Specifically, the three-pipe multi-split hot water system further includes stop valves used for outer connection of the outdoor unit, the stop valves being a liquid-side stop valve 29, an air-side stop valve 30, and a hydraulic module stop valve 31 respectively; the liquid-side stop valve 29 is disposed in the liquid pipe connecting the outdoor unit to any two of the indoor units and the hydraulic module; the air-side stop valve 30 is disposed in the air pipe connecting the outdoor unit to any two of the indoor units; and the hydraulic module stop valve 31 is disposed in the air pipe connecting the outdoor unit to the hydraulic module.

On another aspect, the present invention also discloses a three-pipe multi-split system and a control method thereof; and the three-pipe multi-split system is a three-pipe multi-split system according to the embodiment of the first aspect of the present invention.

Specifically, when the heat exchanger of the outdoor unit is switched on, the outdoor unit is used as a condenser or an evaporator.

Specifically, when the heat exchanger of the outdoor unit is switched on and the outdoor unit is used as a condenser, the one-way valves in the outdoor unit are adjusted so that the first one-way valve 22 and the fourth one-way valve 25 are turned on, and the second one-way valve 23 and the third one-way valve 24 are turned off; when the heat exchanger of the air-conditioning outdoor unit is switched on and the outdoor unit is used as an evaporator, the one-way valves in the outdoor unit are adjusted so that the second one-way valve 23 and the third one-way valve 24 are turned on, and the first one-way valve 22 and the fourth one-way valve 25 are turned off; and when the frequency conversion module temperature sensor 21 for the compressor 1 is high, the first electronic expansion valve 8 and the second electronic expansion valve 9 are switched on.

For example, a three-pipe multi-split system and a control method: when the heat exchanger of the air-conditioning outdoor unit is switched on and the outdoor unit is used as a condenser: a high-temperature and high-pressure refrigerant is compressed and condensed by the finned heat exchanger 5 of the outdoor unit, and then flows toward the refrigerant reversing module 7. The first one-way valve 22 and the fourth one-way valve 25 are turned on; the second one-way valve 23 and the third one-way valve 24 are turned off; and the refrigerant flows through the first one-way valve 22 toward the compressor heat dissipation module 10, a main path of the plate heat exchanger 6, and the first electronic expansion valve 8 to get into the chamber; alternatively, the refrigerant flows toward the compressor 1 through the refrigerant heat dissipation module, the second electronic expansion valve 9, and an auxiliary path of the plate heat exchanger 6, so that when the air-conditioning outdoor unit is used as a condenser, all the refrigerant flowing through the outdoor unit passes through the refrigerant heat dissipation module, to ensure a refrigerant flow needed for refrigerant heat dissipation; meanwhile, the phenomenon that the refrigerant is throttled by the first electronic expansion valve 8 or supercooled by the plate heat exchanger 6 which cause a temperature drop when the refrigerant flows through the refrigerant heat dissipation module and consequent condensation on the refrigerant heat dissipation module can be avoided; when the heat exchanger of the air-conditioning outdoor unit is switched on and the outdoor unit is used as an evaporator: a high-temperature and high-pressure refrigerant is compressed and condensed by the finned heat exchanger 5 of the indoor unit or by the hydraulic module, and then flows toward the refrigerant reversing module 7. The second one-way valve 23 and the third one-way valve 24 are turned on, the first one-way valve 22 and the fourth one-way valve 25 are turned off, and the refrigerant flows through the second one-way valve 23 toward the compressor heat dissipation module 10, the main path of the plate heat exchanger 6, and the first electronic expansion valve 8 to reach the heat exchanger of the outdoor unit; alternatively, the refrigerant flows toward the compressor 1 through the refrigerant heat dissipation module, the second electronic expansion valve 9, and the auxiliary path of the plate heat exchanger 6, so that when the air-conditioning outdoor unit is used as an evaporator, all the refrigerant flowing through the outdoor unit passes through the refrigerant heat dissipation module; meanwhile, the phenomenon that the refrigerant is throttled by the first electronic expansion valve 8 or supercooled by the plate heat exchanger 6 which cause a temperature drop when the refrigerant flows through the refrigerant heat dissipation module and consequent condensation on the refrigerant heat dissipation module can be avoided; when the TIPM of the frequency conversion module temperature sensor 21 is high, the first electronic expansion valve 8 and the second electronic expansion valve 9 are switched on, so that a large amount of refrigerant flows toward the refrigerant heat dissipation module through the refrigerant reversing device to ensure that enough refrigerant flows through the refrigerant heat dissipation module. For example: when the TIPM of the frequency conversion module temperature sensor 21 is lower than 75° C., the first electronic expansion valve 8, the second electronic expansion valve 9, SV5, and SV8 are freely controlled.

When the TIPM of the frequency conversion module temperature sensor 21 is higher than or equal to 75° C., the first electronic expansion valve 8 is forced at 480 steps; SV5, SV8, and the second electronic expansion valve 9 are freely controlled; and when the TIPM of the frequency conversion module temperature sensor 21 is lower than 70° C., normal control is recovered.

When the TIPM of the frequency conversion module temperature sensor 21 continuously rises to 80° C. or above, the first electronic expansion valve 8 is forced at 480 steps; SV5, SV8, and the second electronic expansion valve 9 are forcedly open while the minimum opening of the second electronic expansion valve 9 is not less than 56 steps; and when the TIPM of the frequency conversion module temperature sensor 21 is lower than 75° C., the first electronic expansion valve 8 is forced at 480 steps; and SV5, SV8, and the second electronic expansion valve 9 are freely controlled.

When the TIPM of the frequency conversion module temperature sensor 21 continuously rises to 85° C. or above, the first electronic expansion valve 8 is forced at 480 steps; SV5 and SV8 are forcedly open; the minimum opening of the second electronic expansion valve 9 is not less than 128 steps; and when the TIPM of the frequency conversion module temperature sensor 21 is lower than 80° C., the first electronic expansion valve 8 is forced at 480 steps; and SV5, SV8, and the second electronic expansion valve 9 are forcedly open while the minimum opening of the second electronic expansion valve 9 is not less than 56 steps.

The above description of the disclosed embodiments is for those skilled in the art to implement or use the present invention. Various modifications to these embodiments will be apparent to those skilled in the art; and general principles defined herein can be implemented in other embodiments without departing from the spirit or scope of the present invention. Therefore, the present invention will not be limited to these embodiments herein but should be conform to the broadest range in line with the principles and novel characteristics disclosed herein.

What is claimed is:

1. A three-pipe multi-split hot water system, comprising:

an outdoor unit comprising a compressor (1), an oil separator (2), a first four-way valve (3), a second four-way valve (4), a finned heat exchanger (5), a plate heat exchanger (6), a refrigerant reversing module (7) including an array of one way valves, a first electronic expansion valve (8), a second electronic expansion valve (9), and a compressor heat dissipation module (10) including a radiator, wherein the compressor (1) is communicated with the oil separator (2); the compressor is communicated with the plate heat exchanger (6); and the plate heat exchanger (6) is communicated with the second electronic expansion valve (9);

a multi-split indoor unit equipped with at least a first indoor unit (11) and a second indoor unit (12), each indoor unit comprising an indoor unit heat exchanger (13), an indoor unit electronic expansion valve (14), and an indoor unit fan (15), wherein the indoor unit electronic expansion valve (14) is communicated with the indoor unit heat exchanger (13); and a hydraulic module comprising a refrigerant water heat exchanger (16), a water pump (17), a water flow switch (18), and an electromagnetic valve (19), wherein the water pump (17) is communicated with the water flow switch (18) and equipped with a water temperature detection sensor for detecting water temperature.

2. The three-pipe multi-split hot water system according to claim 1, wherein the compressor (1) is communicated with the oil separator (2), wherein a high-pressure sensor (20) is disposed on a connection between the compressor (1) and the oil separator (2).

3. The three-pipe multi-split hot water system according to claim 1, wherein the multi-split outdoor unit is equipped with a temperature sensor (21) for the compressor (1).

4. The three-pipe multi-split hot water system according to claim 1, further comprising: a first one-way valve (22) that only allows a flow from the finned heat exchanger (5) to the compressor heat dissipation module (10), a second one-way valve (23) that only allows a flow from the refrigerant reversing module (7) to the compressor heat dissipation module (10), a third one-way valve (24) that only allows a flow from the plate heat exchanger (6) to the finned heat exchanger (5), and a fourth one-way valve (25) that only allows a flow from the first electronic expansion valve (8) to the refrigerant reversing module (7).

5. The three-pipe multi-split hot water system according to claim 1, wherein any two of the indoor units are equipped with a first temperature sensor (26) configured to detect the environment of the corresponding indoor unit, a second temperature sensor (27) disposed at a middle of the corresponding indoor unit heat exchanger (13), and a third temperature sensor (28) for detecting the exit temperature of the corresponding indoor unit heat exchanger (13).

6. The three-pipe multi-split hot water system according to claim 1, wherein the outdoor unit is connected to any two of the indoor units by a liquid pipe conveying liquid refrigerant to the indoor units and an air pipe conveying vapor refrigerant to the compressor, wherein the outdoor unit is connected to the hydraulic module through the liquid pipe conveying liquid refrigerant to the hydraulic module and a high-low pressure pipe conveying refrigerant to the compressor.

7. The three-pipe multi-split hot water system according to claim 6, further comprising stop valves used for outer connection of the outdoor unit, the stop valves being a liquid-side stop valve (29), an air-side stop valve (30), and a hydraulic module stop valve (31) respectively, wherein the liquid-side stop valve (29) is disposed in the liquid pipe; the air-side stop valve (30) is disposed in the air pipe; and the hydraulic module stop valve (31) is disposed in the high-low pressure pipe connecting the outdoor unit to the hydraulic module.

* * * * *